US008118037B2

(12) United States Patent
Cardenas et al.

(10) Patent No.: US 8,118,037 B2
(45) Date of Patent: Feb. 21, 2012

(54) ERGONOMIC HAIR COLORING BRUSH

(76) Inventors: Rey Cardenas, San Ramon, CA (US); Evelina Cardenas, San Ramon, CA (US)

( * ) Notice: Subject to any disclaimer, the term of this patent is extended or adjusted under 35 U.S.C. 154(b) by 131 days.

(21) Appl. No.: 12/587,661

(22) Filed: Oct. 9, 2009

(65) Prior Publication Data

US 2011/0083690 A1 Apr. 14, 2011

(51) Int. Cl.
*A45D 24/00* (2006.01)
*A46B 5/02* (2006.01)

(52) U.S. Cl. ..... 132/150; 15/143.1; 132/333

(58) Field of Classification Search ..... 132/112, 132/116, 150, 200, 208, 270; 15/21.1, 22.1, 15/143, 159.1, 160, 143.1; D4/116, 132, D4/135, 138; 16/430, 436, DIG. 12; 81/177.1, 81/489; *A45D 24/00, 24/22, 7/00, 7/02, 19/00, A45D 19/18; A61Q 5/10*

See application file for complete search history.

(56) References Cited

U.S. PATENT DOCUMENTS

| | | | | | |
|---|---|---|---|---|---|
| 2,917,763 | A | * | 12/1959 | Kurschner | 15/106 |
| 5,058,609 | A | | 10/1991 | Sandoz | |
| 5,289,835 | A | | 3/1994 | Harlan | |
| 5,427,120 | A | | 6/1995 | Wong | |
| 5,499,637 | A | | 3/1996 | Foti | |
| 5,507,063 | A | | 4/1996 | Hirsch | |
| 5,551,454 | A | | 9/1996 | Goncalves | |
| D407,526 | S | * | 3/1999 | Weiler et al. | D28/7 |
| 5,881,421 | A | * | 3/1999 | Ducharme | 15/106 |
| 5,947,130 | A | * | 9/1999 | Musum | 132/125 |
| D421,846 | S | * | 3/2000 | Choe | D4/135 |
| 6,092,535 | A | * | 7/2000 | Moore | 132/270 |
| 6,142,157 | A | | 11/2000 | de Laforcade | |
| 6,240,928 | B1 | | 6/2001 | DaSilva | |
| 6,401,290 | B1 | * | 6/2002 | Barton et al. | 15/143.1 |
| RE38,093 | E | * | 4/2003 | Chiou | 30/169 |
| 6,684,887 | B2 | * | 2/2004 | Alexander | 132/112 |
| 7,055,528 | B2 | | 6/2006 | Shah | |
| D527,843 | S | * | 9/2006 | Bartsch et al. | D28/7 |
| 7,322,365 | B2 | | 1/2008 | Kelloyan | |
| 7,779,847 | B2 | * | 8/2010 | Castagno et al. | 132/200 |
| D634,935 | S | * | 3/2011 | Kobke | D4/116 |
| D646,018 | S | * | 9/2011 | Anderson | D28/7 |
| D646,899 | S | * | 10/2011 | Dombrowski et al. | D4/138 |
| 2001/0011528 | A1 | | 8/2001 | Willinger | |
| 2002/0124858 | A1 | | 9/2002 | Nelson | |
| 2003/0005533 | A1 | * | 1/2003 | Woodnorth et al. | 15/143.1 |

(Continued)

FOREIGN PATENT DOCUMENTS

EP 2087810 A1 * 8/2009

OTHER PUBLICATIONS

Sally Beauty, http://sallybeauty.com/color-bowl-brushes/SBS-702030,depault,pd.html, Sep. 4, 2008, pp. 1-2.*

(Continued)

*Primary Examiner* — Todd Manahan
*Assistant Examiner* — Tatiana Nobrega
(74) *Attorney, Agent, or Firm* — Michael A. Ervin; M. A. Ervin & Associates

(57) ABSTRACT

A system of brushes for coloring hair with each brush including an ergonomically shaped handle, recessed valley areas for comfortable and effective finger pressure points, each brush color coded to specific base colors, and each brush provided with a color changing system to alert the user to recent use.

10 Claims, 4 Drawing Sheets

U.S. PATENT DOCUMENTS

| | | | | |
|---|---|---|---|---|
| 2003/0034043 | A1* | 2/2003 | Anselmo | 132/150 |
| 2004/0016439 | A1* | 1/2004 | Alexander | 132/112 |
| 2005/0257803 | A1 | 11/2005 | Albaneze | |
| 2007/0119472 | A1 | 5/2007 | West | |
| 2007/0169790 | A1* | 7/2007 | Castagno et al. | 132/320 |
| 2008/0120761 | A1* | 5/2008 | Yang et al. | 2/167 |
| 2008/0132438 | A1* | 6/2008 | Hoffman et al. | 510/380 |
| 2011/0091391 | A1* | 4/2011 | Ribi | 424/48 |

OTHER PUBLICATIONS

Chromazone Reversible Thermochromics, http://www.chromazone.co.uk/Images/Navbar%20thermochromism.gif, Apr. 29, 2006, pp. 1-2.*

Quality Logo Products Inc., http://qualitylogoproducts.com/lib/howdo-mood-pencils-work.htm, Jan. 30, 2009, pp. 1-3.*

* cited by examiner

ERGONOMIC HAIR COLORING BRUSH

BACKGROUND OF THE INVENTION

1. Field of the Invention

The present invention relates to the field of hair coloring brush applications and particularly to improving the color brushes used in hair salons.

2. Description of Related Art

The art of modern hair coloring has rapidly evolved as the demand has grown for more innovative looks in hair fashion. Many hair color services require not only more than one color to be used during an application, but even different developers of the same color, with more than one formula for a variety of reasons. Different colors such as for highlights and lowlights require multiple amounts of formulas. Often a hairstylist will use the same color on the hair but will use a variety of levels of hydrogen peroxide. An example of this is a desire for darker hair at the scalp, with lighter ends. If the hairstylist desires to brighten the ends without incurring damage to those ends, there is a need for a much lower level of peroxide and yet the same color would be used. The result of all these demands is a need for multiple formulations of hair color or bleach to be used on the same person during a color service. And for the hair to be in optimum condition following the color service, the application of the color or bleach needs to be as precise as possible.

This demand for speed and precision with more variety has put increased pressure on hair colorists to apply colors quickly and precisely without making color mistakes. Often hair color and bleach formulas look the same in their containers, especially after the hydrogen peroxide is added, causing the formula to oxidize and resemble the other formulas being used. This fast, precise work with conventional tint brushes also has led to stress on the wrist and on the hand muscle between the thumb and forefinger, caused by the pressure when gripping a conventional hair coloring brush.

The multitude of similar colors required has also led to an increased probability of color errors in the rush to complete a complex coloring job in a timely manner. A color stylist may often turn to many similar bowls, each with a different tint brush, and not remember which one was last used.

There is a need then for inventive designs in tint brush systems to both relieve the hand stress on colorists and aid them in avoiding mistakes in choosing the correct brush at the right time.

The present invention helps in these regards providing an ergonomically improved brush handle design and by both linking each brush color to the base of the color in the bowl and also signaling to the stylist which brush was last used. This innovative combination results in far fewer mistakes made by the hairstylist.

BRIEF SUMMARY OF THE DISCLOSURE

This need is met by a system of brushes for hair coloring with each brush including at least: a substantially flat brush head containing brush bristles; a first handle section contiguous to the substantially flat brush head and tapering down and joined to a second handle section shaped as a spherical bulge containing hemispherical dimples on the front and back; wherein the second handle section transitions to a third handle section contiguous to the second handle section and shaped approximately as a prolate spheroid that tapers down to a fourth spear-shaped handle section.

In another aspect the system of brushes each has at least a color change material applied around the first, second, or third handle sections that alerts the colorist to whether the brush has been recently used.

In another aspect of the system the outside surfaces of said first handle section and said second handle section comprise a continuous recessed valley that provides a continuous seat for finger pressure on said first or second handle sections.

In another aspect of the system the surface of said first handle section contiguous to said hemispherical dimples on second handle section comprises a recessed valley area that provides pressure points for fingers.

In another aspect the base brushes are each of different colors to facilitate identification with the hair coloring used.

BRIEF DESCRIPTION OF THE DRAWINGS

For a more complete understanding of the present invention, reference is now made to the following drawings, in which.

DETAILED DESCRIPTION OF THE DISCLOSURE

In the following detailed description, reference is made to the accompanying drawings that illustrate embodiments of the present invention. These embodiments are described in sufficient detail to enable a person of ordinary skill in the art to practice the invention without undue experimentation. It should be understood, however, that the embodiments and examples described herein are given by way of illustration only, and not by way of limitation. Various substitutions, modifications, additions, and rearrangements may be made without departing from the spirit of the present invention. Therefore, the description that follows is not to be taken in a limited sense, and the scope of the present invention is defined only by the appended claims.

Figure 1:
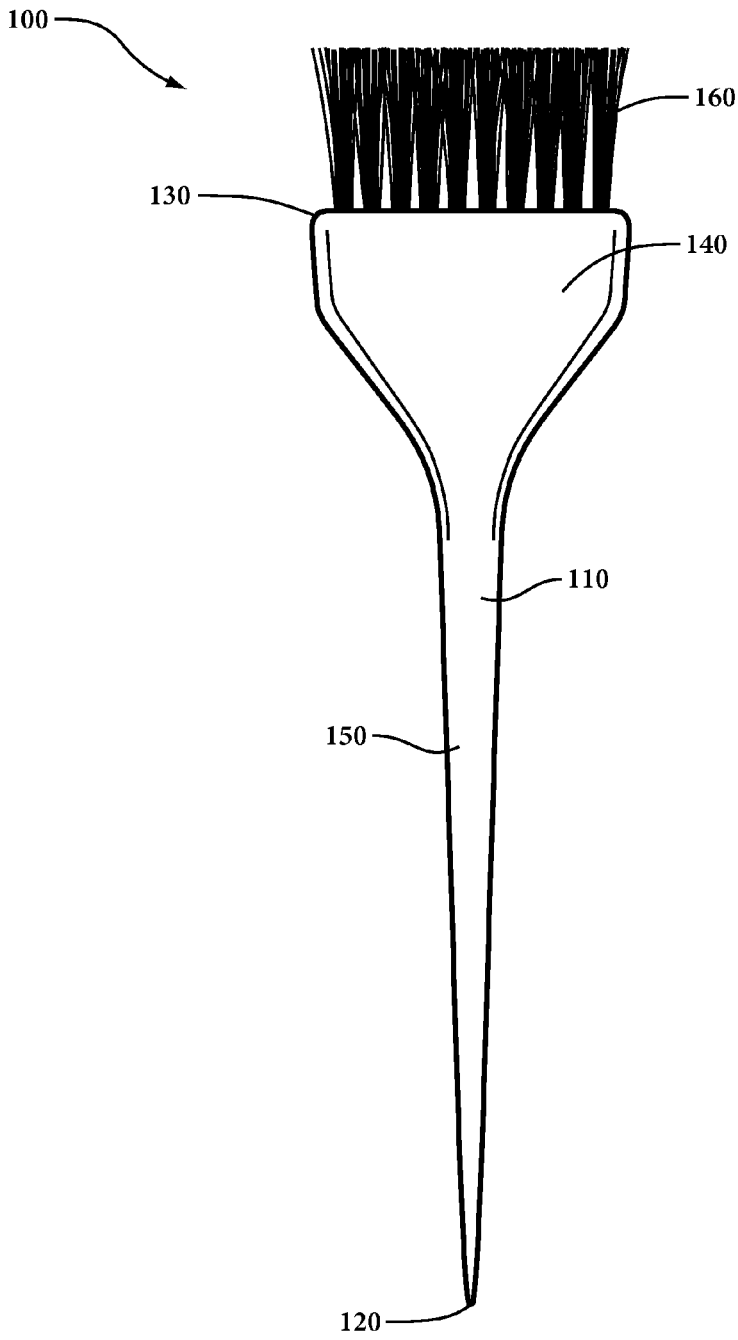
FIG 1 PRIOR ART
FIG. 1 represents a typical tint brush of the prior art.

FIG. 1 illustrates a typical hair-coloring tool 100 of the prior art. An elongated body 110 having opposite ends 120 and 130 is normally tapered toward end 120. Body 110 is larger at the opposite end 130 and defines a substantially flat head 140. Extending between the 110 and the head 140 is a handle portion 150 for gripping by the user.

Projecting from the large end 130 of body 110 are a plurality of flexible bristles 160 arranged in a single row of separate tufts across the head 140. The number and arrangement of these tufts can vary by design and any combination is anticipated by this invention.

Of particular note in this prior art hair coloring tool is that the shape of handle 50 requires a continuous strong grip by the hair colorist while applying the pressure of the hair-coloring tool to the hair. This type of handle and the grip required creates stress on the wrist and on the hand muscle between the thumb and forefinger during work sessions.

Figure 2:
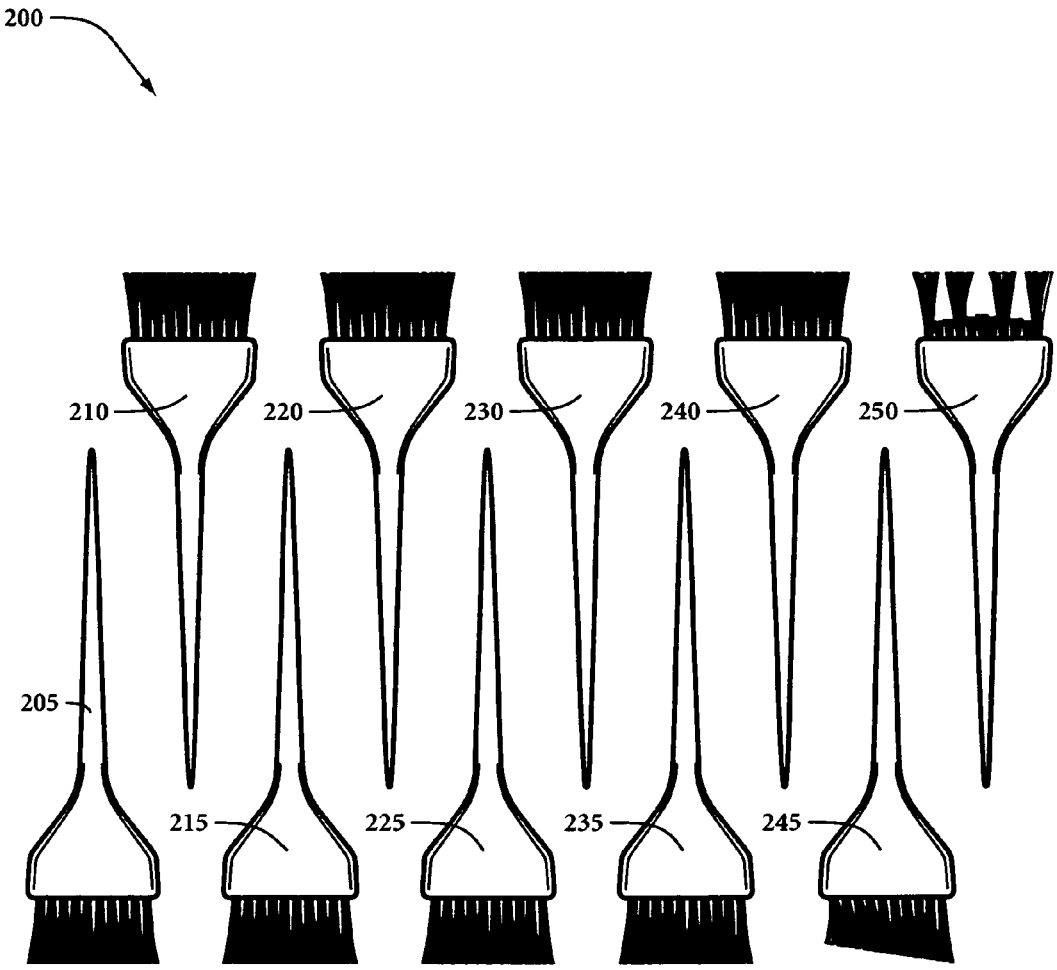
FIG. 2 is an illustration of the underlying base brushes of a color-coded brush system of the present invention to be used in a variety of different hair color bowls.

FIG. 2, represented generally by the numeral 200, illustrates the underlying structure of a series of brushes of the instant invention. The underlying structure is quite similar to the brush of the prior art as shown in FIG. 1, with an elongated body and having a substantially flat head 315 with flexible bristles arranged in a row of separate tufts across the flat end. But this is not the final structure of the brushes of the instant invention. Each brush handle shown in FIG. 2 is of a different color to facilitate identification with the hair coloring in the individual bowls in which the brushes reside. The colors are the base colors used in the industry. White 205, violet 210, yellow 215, orange 220, red 225, green 230, blue 235, and mahogany 240. Brush 250 is both black and designed for use in a technique called balayage or freeform color embellishment. A typical set may contain more than one special brush such as the balayage brush.

Figure 3A:
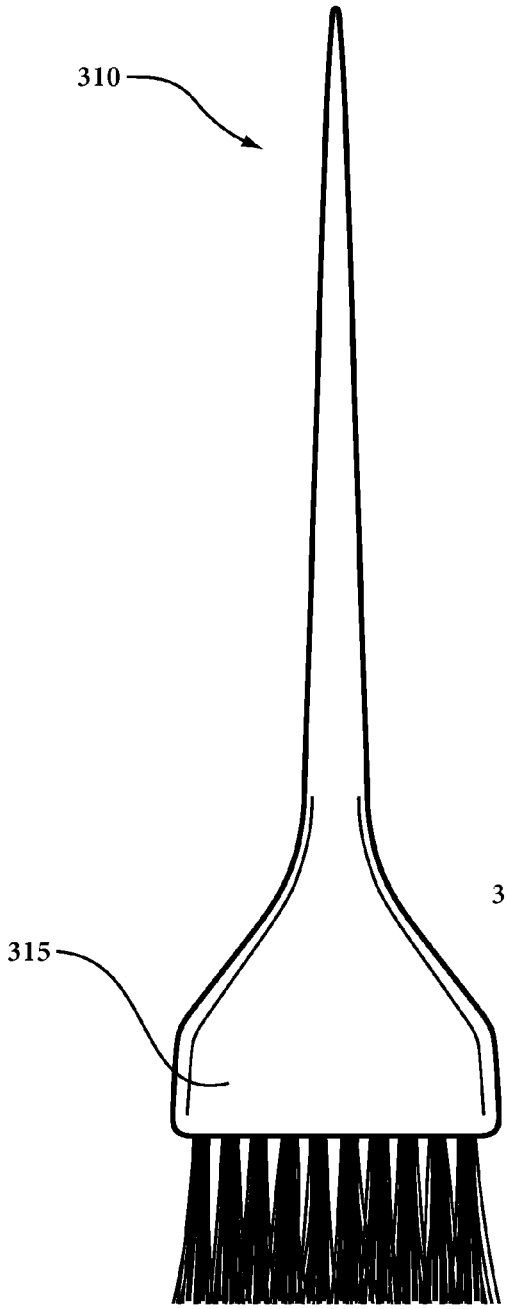
FIG 3A PRIOR ART
FIG. 3A is an illustration of a prior art coloring brush and FIG. 3B is an illustration of the ergonomic coloring brush handle and overlay applied to each base brush handle structure.
Figure 3B:
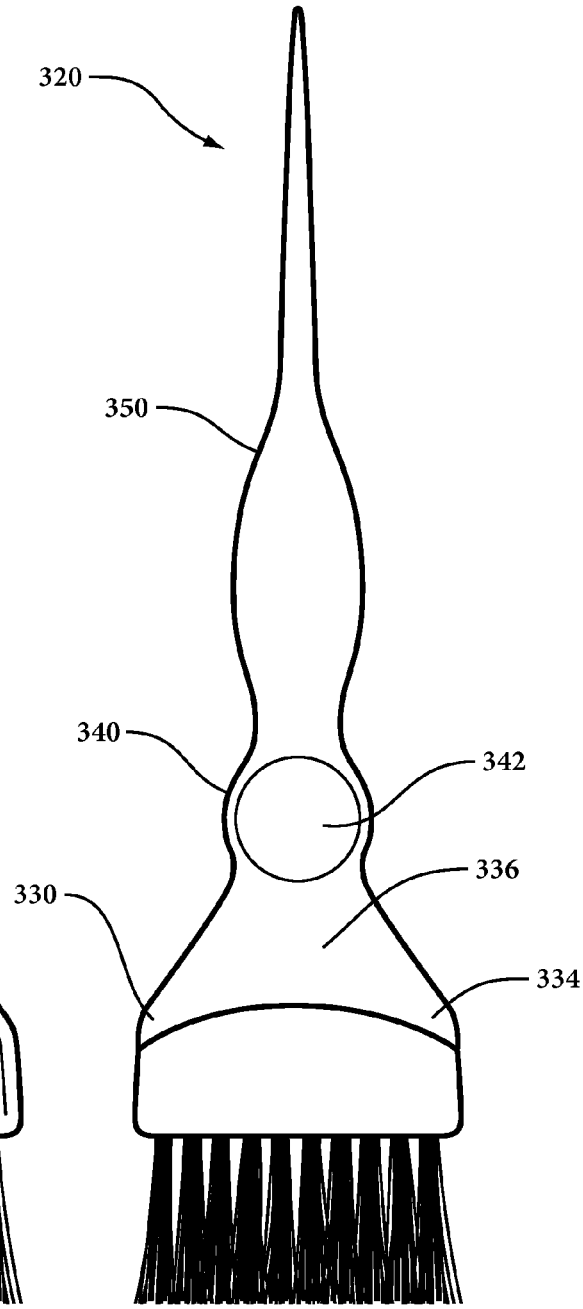

FIG. 3B illustrates the ergonomic design of the instant invention. A tapered hair-coloring tool 310, similar to prior art tools, is shown in FIG. 3A before the added overlay structure of the invention. The instant invention hair-coloring tool 320 has been designed with an ergonomic overlay shape in three sections to relieve the stress on a hair colorists hands and forearms by conforming to the shape of the hand so that the colorist can apply downward controlled pressure without having to grip it tightly. A first handle section, represented generally by the numeral 336, is contiguous to the substantially flat head 315 of the brush and tapers down to join a second handle section 340, which is shaped as a spherical bulge containing hemispherical dimples 342 on the front and back (not shown) of the brush. This second handle section 340 then expands and blends into a third section 350, shaped as an extended prolate spheroid for comfortable resting in the palm of the hand. Finally third section 350 tapers down to the thinner spear shaped brush handle characteristic of prior art brushes.

Figure 4:
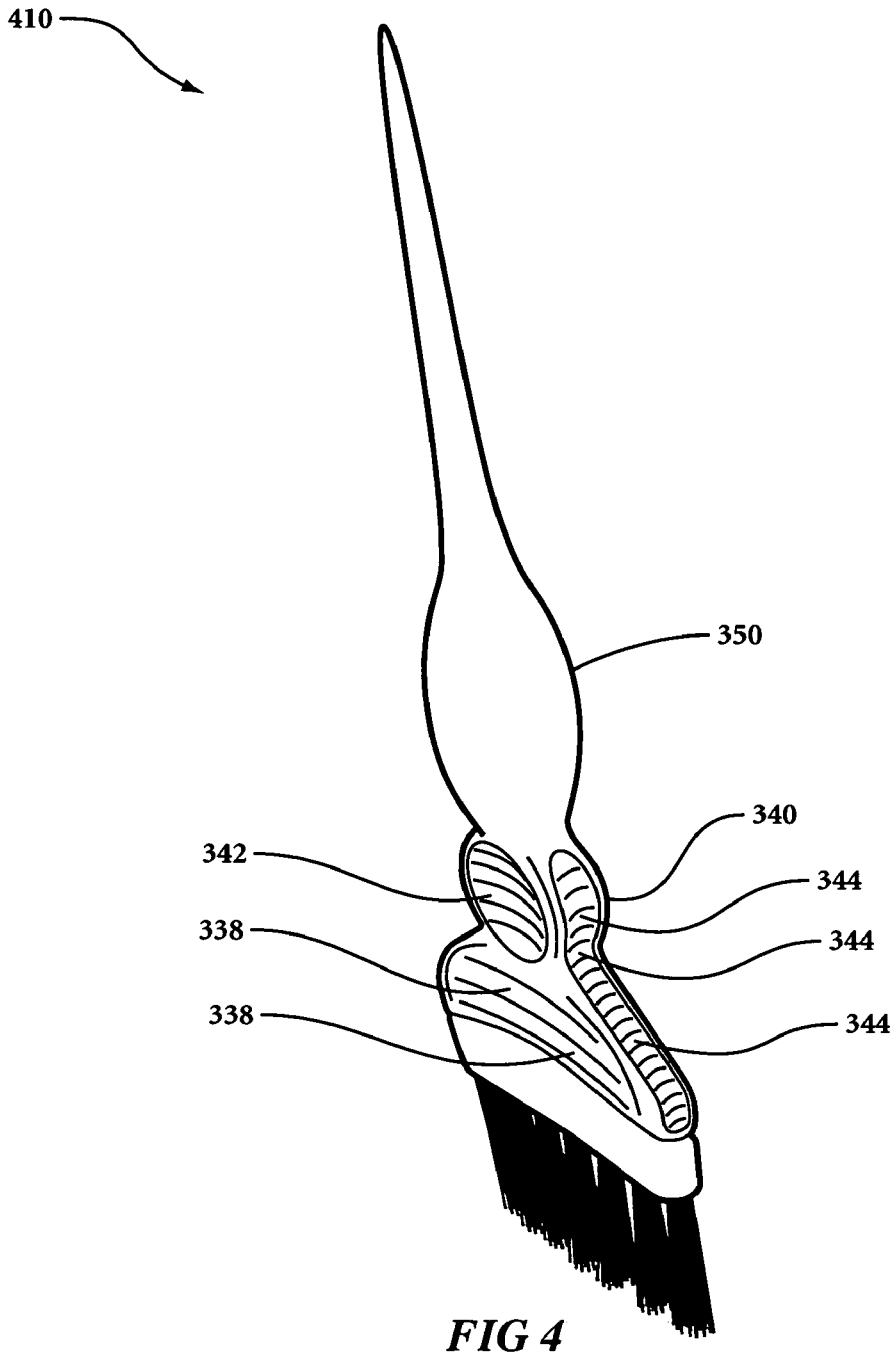
FIG. 4 is a perspective view of an ergonomic coloring brush of the inventive system.

FIG. 4 illustrates a perspective view of the ergonomic hair coloring brush shown previously in FIG. 3 and enables a better description of the unique aspects of the ergonomic design. Ergonomic hair coloring brush 410 again has an ergonomic shape in three sections to relieve the stress on a hair colorists hands and forearms by conforming to the shape of the hand so that the colorist can apply downward controlled pressure without having to grip it tightly. A first handle section, represented generally by the numeral 338, is contiguous to the substantially flat head 315 of the brush and tapers down to join a second handle section 340, which is shaped as a spherical bulge containing hemispherical dimples 342 on the front and back (not shown) of the brush. This second handle section then expands and blends into a third section 350, shaped as an extended prolate spheroid for comfortable resting in the palm of the hand. Finally third section 350 tapers down to the fourth thinner spear shaped brush handle characteristic of prior art brushes.

In addition to the indentation dimples 342 in the second handle section of the hair coloring brush handle, FIG. 4 exhibits that the area 338 in the first handle section has a recessed valley area that slopes down from the second handle section toward the broad brush bristle area section, providing a seat for light finger pressure on the brush. In addition a recessed valley area 344 on the outside surface of the second handle section creates a seat for finger pressure points rather than a flat slippery surface. This recessed valley extends from the outside surface of the second handle section of the handle continuously down the outside surface of the first handle section to the broad flat head of the brush. This recessed valley on the outside surface provides a seat for fingers on either side of the brush, reducing the pressure the colorist has to apply while applying brush strokes to the hair. In total all of the recessed valley areas 342, 338, 344, provide seats for finger pressure points that reduce gripping pressure on the colorist's hands and forearms.

Tool 410 can be held in a more relaxed manner in a variety of positions depending on the particular type of color application being done. The hemispherical dimples 342 of second handle section 340 provide a center pressure balance point for placing the index finger for standard color application. Numerous pressure balance points in the recessed valley area 338 can be used with the fingers when using striping strokes in some hair painting techniques such as balayage. This recessed valley area also allows a comfortable pivot point from color application to sectioning of the hair. The broad section 350 rides comfortably against the heel of the hand. In none of these configurations is it necessary for the stylist to maintain the tight grip and resulting stress required by the use of prior art brushes.

Another aspect of the instant invention is a color change (thermo chromic) material (not shown) applied around any or all of the sections of tool 410. The color change material will completely change in color when gripped by a human hand. Thermo chromic color changing materials can be prepared based on thermo-chromatic liquid crystals or by the use of leuco dyes and the instant invention anticipates either of these approaches. As a hair colorist moves quickly from one color bowl to another, each with it's matching color tool, one of the more common mistakes is to lose track of which brush/color combination was last used. With the color change handles on each brush in this system the colorist will instantly be able to see which brush was last used.

A number of methods, such as injection molding, could be used to fabricate the overlay over the underlying brush structure 310 (from FIG. 3) and the invention anticipates any of these. It is also anticipated that the complete brush structure of brush 320, 410 could be manufactured in one piece without using a separate overlay.

Although certain embodiments of the present invention and their advantages have been described herein in detail, it should be understood that various changes, substitutions and alterations can be made without departing from the spirit and scope of the invention as defined by the appended claims. Moreover, the scope of the present invention is not intended to be limited to the particular embodiments of the processes, machines, manufactures, means, methods, and steps described herein. As a person of ordinary skill in the art will readily appreciate from this disclosure, other processes, machines, manufactures, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufactures, means, methods, or steps.

We claim:

1. A system of ergonomic brushes for coloring hair with each brush comprising:

a. a substantially flat brush head containing brush bristles;

b. a first handle section contiguous to said substantially flat brush head having an outer contour perimeter in which a first portion tapers to a second portion shaped as a spherical bulge containing hemispherical dimples on the front and back; wherein the first and second portion form a first junction and the width of the first junction is smaller than a maximum width of the second portion c. wherein said second handle section expands to a third handle section contiguous to said second handle section, said third handle section having an outer contour perimeter shaped approximately as a prolate spheroid that tapers down to a fourth spear-shaped handle section wherein the second and third portion form a second junction and the width of the second junction is smaller than the maximum width of the second portion and a maximum width of the third portion.

2. The system of ergonomic brushes for coloring hair of claim 1 with each brush further comprising a color change material applied around the first, second, or third handle sections.

3. The system of ergonomic brushes for coloring hair of claim 2 wherein said color change material is prepared from thermo-chromatic liquid crystals.

4. The system of ergonomic brushes for coloring hair of claim 2 wherein said color change material is prepared from leuco dyes.

5. The system of ergonomic brushes for coloring hair of claim 2 wherein said color change material is disposed around said first handle section.

6. The system of ergonomic brushes for coloring hair of claim 2 wherein said color change material is disposed around said second handle section.

7. The system of ergonomic brushes for coloring hair of claim 2 wherein said color change material is disposed around said third handle section.

8. The system of ergonomic brushes for coloring hair of claim 1 wherein the outside surfaces of said first handle section and said second handle section comprise a continuous recessed valley (344) that provides a continuous seat for finger pressure on said first or second handle sections.

9. The system of ergonomic brushes for coloring hair of claim 1 wherein the surface of said first handle section contiguous to said hemispherical dimples on second handle section comprises a recessed valley area (338) that provides pressure points for fingers.

10. The system of ergonomic brushes for coloring hair of claim 1 in which the different brush handles are each of different colors to facilitate identification with the hair coloring used.

* * * * *